US011148146B2

(12) United States Patent
Boulay et al.

(10) Patent No.: US 11,148,146 B2
(45) Date of Patent: Oct. 19, 2021

(54) CONE CRUSHER

(71) Applicant: Metso Outotec Finland Oy, Tampere (FI)

(72) Inventors: Pierrick Boulay, Vinzelles (FR); Mika Peltonen, Tampere (FI); Paulo Barscevicius, Sorocaba (BR); Aki Lautala, Tampere (FI); Nicolas Gallay, Montagny-sur-Grosne (FR); Jonathon Hoogland, New Berlin, WI (US); Andrzej Niklewski, Alto de Pinheiros (BR); Maxime Delahaye, Amancy (FR); Kari Kuvaja, Tampere (FI)

(73) Assignee: Metso Outotec Finland Oy, Tampere (FI)

( * ) Notice: Subject to any disclaimer, the term of this patent is extended or adjusted under 35 U.S.C. 154(b) by 90 days.

(21) Appl. No.: 16/363,477

(22) Filed: Mar. 25, 2019

(65) Prior Publication Data

US 2020/0306762 A1 Oct. 1, 2020

(51) Int. Cl.
*B02C 2/04* (2006.01)
*B02C 2/02* (2006.01)

(52) U.S. Cl.
CPC ..... *B02C 2/047* (2013.01); *B02C 2/02* (2013.01); *B02C 2/042* (2013.01)

(58) Field of Classification Search
CPC ..... B02C 2/047; B02C 2/02; B02C 2/042; B02C 2210/02; B02C 2/04
(Continued)

(56) References Cited

U.S. PATENT DOCUMENTS 2,310,737 A 2/1943 Gruender
3,417,932 A * 12/1968 Patterson ..... B02C 2/04 241/208

(Continued)

FOREIGN PATENT DOCUMENTS

CN 108636495 A 10/2018
WO 2011005169 A1 1/2011

OTHER PUBLICATIONS

Natasha Parks, "How to Calculate Piston Force," Sciencing (Mar. 13, 2018), https://sciencing.com/calculate-piston-force-7476402.html (Year: 2018).*

(Continued)

*Primary Examiner* — Adam J Eiseman
*Assistant Examiner* — Matthew Stephens
(74) *Attorney, Agent, or Firm* — Andrus Intellectual Property Law, LLP

(57) ABSTRACT

A cone crusher, including a supporting device being arranged inside a cavity of a main shaft of the crusher. The supporting device is arranged to support a crushing head, and to be vertically displaceable for adjusting the width of a crushing gap. The supporting device has an upper portion enclosed by the crushing head, the upper portion being arranged to provide support to the crushing head. A lower portion extends downwards within the cavity of the main shaft, wherein the upper portion and the lower portion have different outer dimensions as defined transverse to the shaft axis. A pressure-active surface is formed at a transition between the upper portion and the lower portion so as to form a variable-volume compression chamber within the cavity below the pressure-active surface.

19 Claims, 4 Drawing Sheets

(58) Field of Classification Search
USPC ..... 241/215, 211
See application file for complete search history.

(56) References Cited

U.S. PATENT DOCUMENTS

| | | | | |
|---|---|---|---|---|
| 3,801,026 | A | 4/1974 | Decker et al. | |
| 7,673,821 | B2 | 3/2010 | Norrman et al. | |
| 8,240,587 | B2 * | 8/2012 | Gunnarsson | B02C 2/04 241/216 |
| 2006/0144979 | A1 * | 7/2006 | Nieminen | B02C 2/047 241/259 |
| 2010/0116915 | A1 * | 5/2010 | Norrman | B02C 2/04 241/30 |
| 2011/0006143 | A1 | 1/2011 | Gunnarsson et al. | |
| 2014/0021280 | A1 * | 1/2014 | Anttila | B02C 2/047 241/214 |
| 2015/0020629 | A1 * | 7/2015 | Aberg | B02C 2/04 241/214 |
| 2015/0202629 | A1 | 7/2015 | Aberg et al. | |

OTHER PUBLICATIONS

International Search Report and Written Opinion for corresponding International Application No. PCT/IB2020/052753 dated Jun. 15, 2020.

* cited by examiner

CONE CRUSHER

FIELD OF THE INVENTION

The present invention relates to a cone crusher.

BACKGROUND ART

Cone crushers are a kind of rock crushing systems, which generally break apart rock, stone or other material in a crushing gap between a stationary element and a moving element. A cone crusher is comprised of a head assembly including a crusher head that gyrates about a vertical axis within a stationary bowl attached to a main frame of the crusher. The crusher head is assembled surrounding an eccentric that rotates about a fixed main shaft to impart a gyratory pendulum movement of the crusher head which crushes rock, stone or other material in a crushing gap formed between the crusher head and the bowl. The eccentric can be driven by a variety of power drives, such as an attached gear, driven by a pinion and countershaft assembly, and a number of mechanical power sources, such as electrical motors or combustion engines. The gyrational movement of the crusher head with respect to the stationary bowl crushes rock, stone or other material as it travels through the crushing gap. The crushed material exits the cone crusher through the bottom of the crushing gap.

A challenge faced with cone crushers is that the crushing process results in an excessive wear of the crushing surfaces forming the crushing gap. For the purpose, both the moving crusher head and the stationary bowl are equipped with crushing liners made from a wear-resistant material, such as e.g. manganese steel. It should be noted in this respect that the bowl is stationary during the crushing process but it is moveable to be able to adjust for wear and tear of the wear surfaces and this adjustment is typically done when no crushing is taking place. Due to the wear, the thickness of the crushing liners will decrease as material is worn of wear surfaces thereof. In absence of any preventive measures, this would result in a monotonically increasing crushing gap as function of time. To keep the crushing gap under control at all times, cone crushers typically have a built-in functionality for adjusting the crusher gap during operation. One such functionality involves mounting the crusher head on a supporting structure which may be displaced vertically so as to adjust the height of the crusher head. One kind of such vertically displaceable supporting structure comprises a hydraulic piston device located within a cavity of the cone crusher main shaft and connecting to the crusher head at a top thereof.

During operation, material is constantly passing through the crushing gap between the crusher head and the bowl for being crushed, thus exerting forces on the crushing head as material is compressed between the gap surfaces. These forces will be further transported into the piston device supporting the crusher head. Thus, support between the main shaft and the piston device is important. If support is not good enough, especially the upper part of the piston and the corresponding support surfaces around the piston and bushing parts may experience excessive wear, which may finally lead to piston seal failure. Poor support may also lead to head tilting, damaging support surfaces such as bearings, bushings and other mechanical components. There is thus a need in the art for an improved cone crusher.

SUMMARY

It is an object to mitigate, alleviate or eliminate one or more of the above-identified deficiencies in the art and disadvantages singly or in any combination and solve at least the above mentioned problem. According to a first aspect there is provided a cone crusher, comprising:

a crushing head being rotatably arranged about a substantially vertical main shaft and on which crushing head a first crushing liner is mounted;

a frame, on which a second crushing liner is mounted, such that the first crushing liner and the second crushing liner together defines a crushing gap;

an eccentric rotatably arranged about a shaft axis defined by the main shaft;

a drive unit arranged to rotate said eccentric such that the crushing head, which is rotatably arranged on the eccentric, executes a gyratory pendulum movement for crushing of material introduced into the crushing gap, and a supporting device being arranged inside a cavity of said main shaft, said supporting device being arranged to support the crushing head, and to be displaceable along the shaft axis for adjusting the width of the crushing gap, wherein the supporting device has an upper portion enclosed by the crushing head, said upper portion being arranged to provide said support to the crushing head, and a lower portion extending downwards within the cavity of the main shaft, wherein the upper portion and the lower portion have different outer dimensions as defined transverse to the shaft axis, such that a pressure-active surface is formed at a transition between the upper portion and the lower portion so as to form a variable-volume compression chamber within the cavity below said pressure-active surface, wherein the supporting device is transversely supported within the cavity at least at an upper support position at which the upper portion is transversely supported by the main shaft, and at a lower support position at which the lower portion is transversely supported by the main shaft.

The upper portion of the supporting device and the lower portion of the supporting device are disposed in relation to each other such that the pressure-active surface may be formed at a transition between the portions. This implies that the upper and lower portions are close to each other. The upper and lower portions may be adjacent to each other. However, it is conceivable that the upper and lower portions have an intermediate portion in between them. In such a case, the intermediate portion may define the transition between the upper and lower portions as well as defining the pressure-active surface. In case of the supporting device having an axisymmetric geometry, the intermediate portion may define a frustoconical outer surface connecting to cylindrical outer surfaces of the upper and lower portions, respectively.

The upper and lower portions may be defined by a respective element, or assembly. Thus, the upper portion of the supporting device may be fixedly attached to the lower portion of the supporting device. However, it is also conceivable that the supporting device comprises one single element defining both the upper portion and the lower portion.

The supporting device is displaceable within the cavity along the shaft axis. This implies that the supporting device is slidably arranged within the cavity.

The supporting device and the cavity are shaped so as to define a variable-volume compression chamber at a relatively high vertical position within the main shaft of the crusher. This may be advantageous as the support position on which the weight of the crusher head assembly will rest, will be situated relatively high. This results in a generally improved balance of forces within the supporting device and main shaft as compared to the conventional design of having the variable-volume compression chamber situated at the bottom of the main shaft. A further advantage of the supporting device having an upper portion different from a lower portion is that it generally provides more degree of freedom for a particular design for a particular crusher, as compared to the solutions of the prior art where the supporting device typically has a constant transversal cross section as function of axial position. A further advantage of the design is that the supporting device and hydraulic system is more easy to access. Today, service is typically performed from under the cone crusher, a process which imposes limited space to perform service actions and which may therefore increase required service time. With the proposed design, service could instead be performed from the top of the crusher. The lower portion of the supporting device extends downwards and increases overall stability of the supporting device.

According to some embodiments, the supporting device is axisymmetric and wherein the upper portion has a first outer radial diameter and the lower portion has a second, smaller, outer radial diameter.

According to some embodiments, a ratio between the first outer radial diameter and the second outer radial diameter is within the range 1.25-4, preferably 1.75-2.5.

This may be advantageous as it allows for an optimal balance between having a large-enough pressure-active surface for the hydraulic oil to work on, and keeping a large-enough dimension of the lower portion for high structural integrity. It should be noted as well that an increase in dimension of the second radial diameter automatically reduces the dimensions of the main shaft due since it will reduce the volume available to the main shaft. Thus, reducing the second diameter will increase strength of the main shaft which will be less sensitive to bending.

According to some embodiments, a ratio between a vertical dimension of the lower portion and a vertical dimension of the upper portion is at least 1, preferably 1.5 and more preferably at least 3.

A ratio of less than 1 is less preferable since the forces at the support points will increase with reduced length of the lower portion. In any case, the length of the lower portion must be at least as long as the travel distance of the supporting device. In some embodiments it should be at least 1.5 times the travel distance. In one embodiment it reaches all the way to the bottom of the main shaft.

According to some embodiments, the cavity of the main shaft has a length such that, when the supporting device is in a lowermost vertical displacement position, the lower portion of the support device extends downwards within the cavity of the main shaft such that parts of said lower portion extends below the eccentric.

According to some embodiments, the cavity of the main shaft has a length such that when the supporting device is in an uppermost vertical displacement position, the cavity of the main shaft has a remaining length below a lower end of the supporting device which is preferably at least 120% of the maximum stroke of the supporting device.

According to some embodiments, the cone crusher further comprises a bearing assembly comprising a set of axial bearings connecting the upper portion of the supporting device with the crushing head, and an upper radial support bearing connecting, at the upper support position, the upper portion of the supporting device with an inner wall of the cavity.

According to some embodiments, at least one from the support device and the main shaft comprises a lubricating-oil channel system configured to provide lubricating oil to the set of axial bearings and/or the upper radial support bearing.

The lubricating-oil channel system may be further configured to provide lubrication oil to further bearings, such as radial bearings located between the eccentric and the main shaft, and radial bearings located between the eccentric and the crushing head. Another example of such a further bearing is the axial bearings arranged to vertically support the eccentric.

According to some embodiments, lubrication oil enters a chamber within the crushing head and enters the radial bearings located between the crushing head and the eccentric and the radial bearings located between the eccentric and the main shaft, and may by gravitational forces reach the axial bearings located beneath the eccentric. Excessive oil amounts may also be taken care of by means of dedicated draining openings leading from the chamber within the crushing head.

According to some embodiments, an upper sealing is provided for sealingly connecting surfaces of the upper portion of the supporting device with surfaces of the cavity. The supporting device may comprise the upper sealing. The upper sealing may be a lip seal. A purpose of the upper sealing is to sealingly connect surfaces of the supporting device with surfaces of the cavity so as to hermetically seal off the compression chamber.

According to some embodiments, the supporting device is transversely supported within the cavity at an intermediate support position located in between the upper and lower support positions, and at which intermediate support position the lower portion is transversely supported by the main shaft.

According to some embodiments, the intermediate support position is located adjacent or at least near a bottom surface of the variable-volume compression chamber.

According to some embodiments, the cone crusher further comprises an intermediate radial support bearing connecting, at the intermediate support position, the supporting device with an inner wall of the cavity.

According to some embodiments, the lubricating-oil channel system is further configured to provide lubricating oil to the intermediate radial support bearing.

According to some embodiments, the supporting device further comprises an intermediate sealing for sealingly connecting surfaces of the supporting device with surfaces of the cavity. The intermediate sealing is preferably located near or even adjacent to the intermediate support position. The intermediate sealing may be located below or above the intermediate support position. Even more preferably, the intermediate sealing is located above the intermediate support position. The intermediate sealing may be flush with a bottom surface of the compression chamber. The purpose of the intermediate sealing is to sealingly connect surfaces of the supporting device with surfaces of the cavity so as to hermetically seal off the compression chamber from the lower parts of the cavity.

According to some embodiments, the intermediate support position is located below the intermediate sealing which seals the variable-volume compression chamber.

According to some embodiments, the main shaft comprises a hydraulic-oil channel system configured to provide hydraulic oil to the compression chamber for providing said support and displaceability of the crushing head.

A further scope of applicability of the present invention will become apparent from the detailed description given below. However, it should be understood that the detailed description and specific examples, while indicating preferred embodiments of the invention, are given by way of illustration only, since various changes and modifications within the scope of the invention will become apparent to those skilled in the art from this detailed description.

Hence, it is to be understood that this invention is not limited to the particular component parts of the device described or steps of the methods described as such device and method may vary. It is also to be understood that the terminology used herein is for purpose of describing particular embodiments only, and is not intended to be limiting. It must be noted that, as used in the specification and the appended claim, the articles "a", "an", "the", and "said" are intended to mean that there are one or more of the elements unless the context clearly dictates otherwise. Thus, for example, reference to "a unit" or "the unit" may include several devices, and the like. Furthermore, the words "comprising", "including", "containing" and similar wordings does not exclude other elements or steps.

BRIEF DESCRIPTIONS OF THE DRAWINGS

The invention will by way of example be described in more detail with reference to the appended [schematic] drawings, which shows presently preferred embodiments of the invention.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1A:
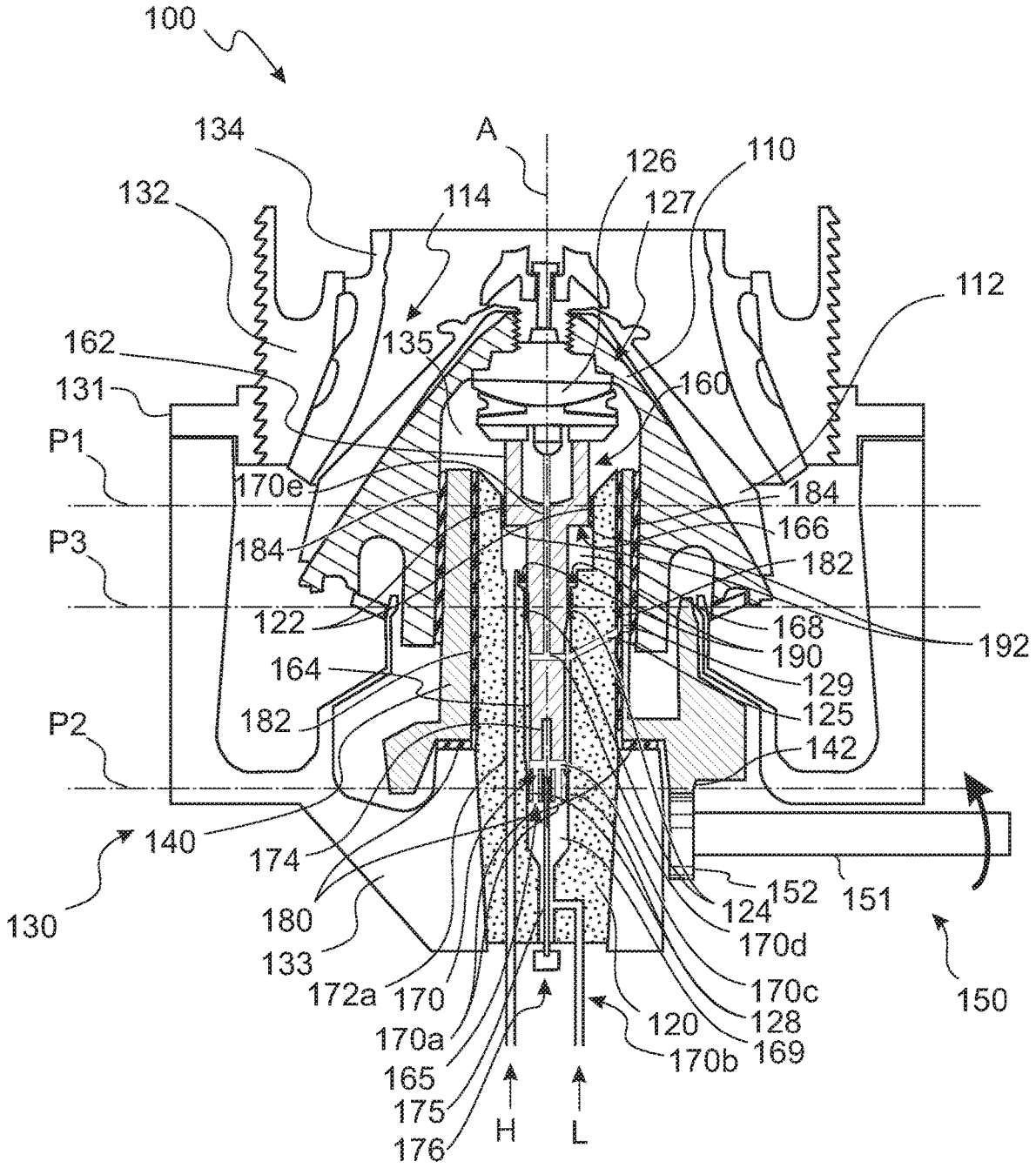
FIG. 1A shows a cross-section of a cone crusher according to an embodiment of the present disclosure.

FIG. 1A shows a cross-sectional view of a cone crusher 100 according to an example embodiment. The cone crusher 100 comprises a frame 130 including a lower frame part 133 and an upper frame part 131. The cone crusher 100 further comprises a vertical main shaft 120 which is fixedly connected to the lower frame part 133. The main shaft 120 defines a vertically aligned shaft axis A. An eccentric 140 is rotatably arranged about the main shaft 120 so as to be rotatable around the centre axis A. An outer surface of the eccentric 140 is inclined in relation to shaft axis A, as can be seen in FIG. 1A. A crushing head 110 is rotatably arranged about the eccentric 140. Due to the inclination of the outer surface of the eccentric 140, the crushing head 110, too, will incline somewhat in relation to the shaft axis A. The cone crusher 100 further comprises a drive unit 150 arranged to rotate said eccentric 140 about the main shaft 120 by means of a drive shaft 151 having a gear 152 in engagement with a bevel gear 142 of the eccentric 140. As the drive shaft 151 rotates, the eccentric 140 will rotate with it, whereby the crushing head 110, which is rotatably arranged on the eccentric 140, executes a gyratory pendulum movement about the main shaft 120.

A first crushing liner 112 is mounted on the crushing head 110. A rotatable part 132 is connected to the upper frame part 131 and a second crushing liner 134 is mounted on that rotatable part 132. The first crushing liner 112 and the second crushing liner 134 together define a crushing gap 114. As crushing material, such as stone, gravel, ore or the like, enters the crushing gap 114, the gyratory pendulum movement of the crushing head 110 will result in an alternatingly increasing and decreasing distance between the first 112 and second 134 crushing liners. This movement will crush the material as it passes through the crushing gap 114.

Between the eccentric 140 and the main shaft 120 and between the eccentric 140 and the crushing head 110 radial bearings 182, 184 are arranged to provide support and absorbing loads which are generated during the crushing. An important purpose of these radial bearings is to act as sacrificing elements protecting other elements of the crusher in case of e.g. excess load situations or lubrication failure. The set of radial bearings 182, 184 may comprise e.g. one, two or more bushings such as one piece bushings or two piece bushings. It should be noted that some of the radial bearings may or may not be capable of absorb axial, or vertical, load components as well. For example, radial bearing 184 which is arranged on the eccentric 140 which has an inclined outer surface. The eccentric 140 is vertically supported by axial bearings 180.

Figure 1B:
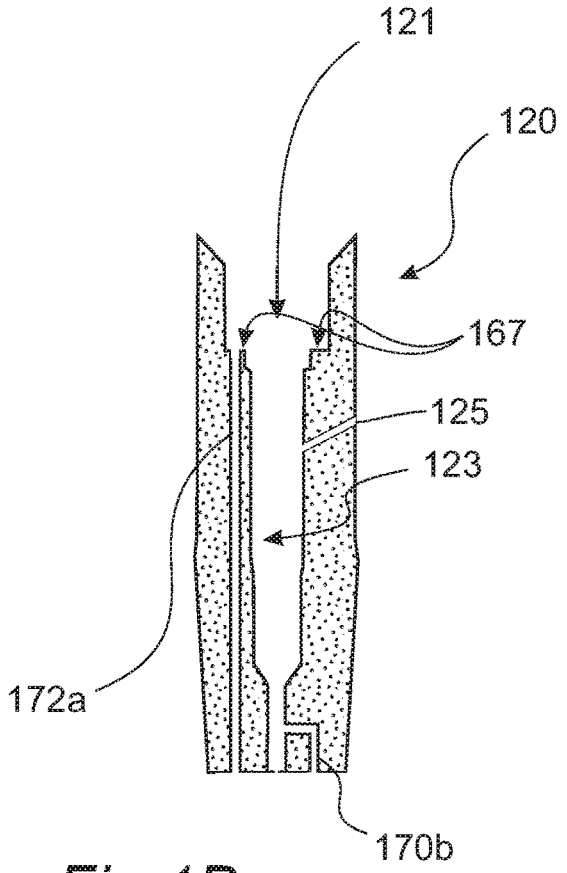
FIG. 1B shows a cross-section of a main shaft of the cone crusher according to the embodiment of FIG. 1A.

The cone crusher 100 further comprises a supporting device 160 being arranged inside a cavity 121 of the main shaft 120 (See FIG. 1B). The supporting device 160 is arranged to support the crushing head 110, and to be displaceable along the shaft axis A for adjusting the width of the crushing gap 114. In other words, the supporting device 160 enables a vertical adjustment of the crushing head 110. The (vertical) displacement D of the supporting device 160 is illustrated in FIG. 1D. The supporting device 160 is axisymmetric but rotation can be prevented with a pin or other suitable means.

The supporting device 160 has an upper portion 162 enclosed by the crushing head 110, the upper portion 162 being arranged to provide said support to the crushing head 110. A bearing assembly 127 attached on top of the upper portion 162 of the supporting device 160 connects the supporting device 160 with the crushing head 110. The bearing assembly 127 comprises a set of axial bearings 126. The axial bearings 126 enable inclination and horizontal movement of the crushing head 110 during its gyrating movement.

The supporting device 160 further has a lower portion 164 extending downwards within the cavity 121 of the main shaft 120, as can be seen in FIG. 1B.

Figure 1C:
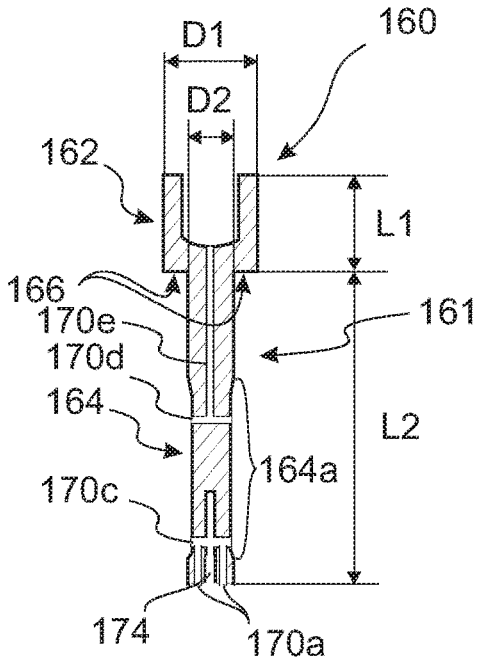
FIG. 1C shows a cross-section of a supporting device of the cone crusher according to the embodiment of FIG. 1A.
Figure 1D:
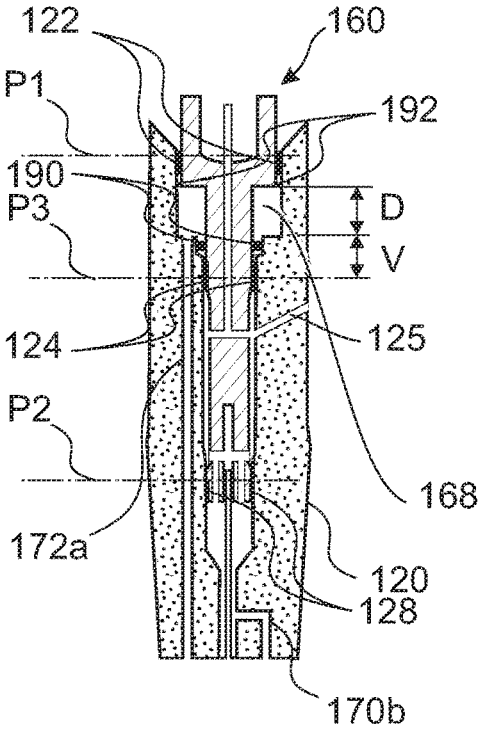
FIG. 1D shows a cross-section of the supporting device and the main shaft according to the embodiment of FIG. 1A.
Figure 2A:
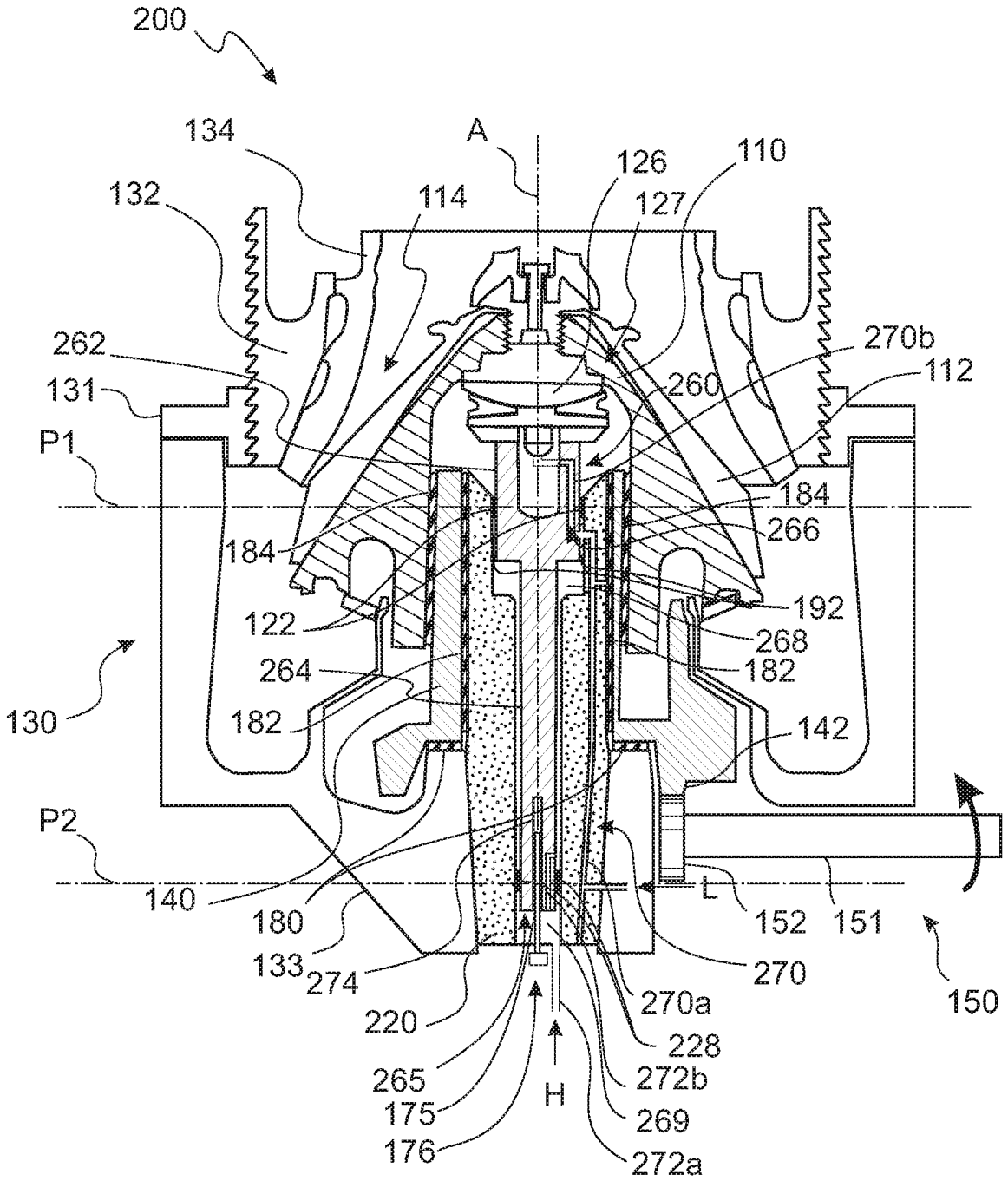
FIG. 2A shows a cross-section of a cone crusher according to another embodiment of the present disclosure.
Figure 2B:
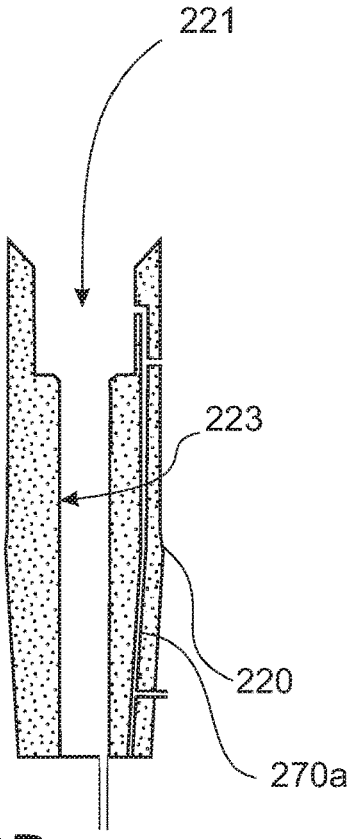
FIG. 2B shows a cross-section of a main shaft of the cone crusher according to the embodiment of FIG. 2A.
Figure 2C:
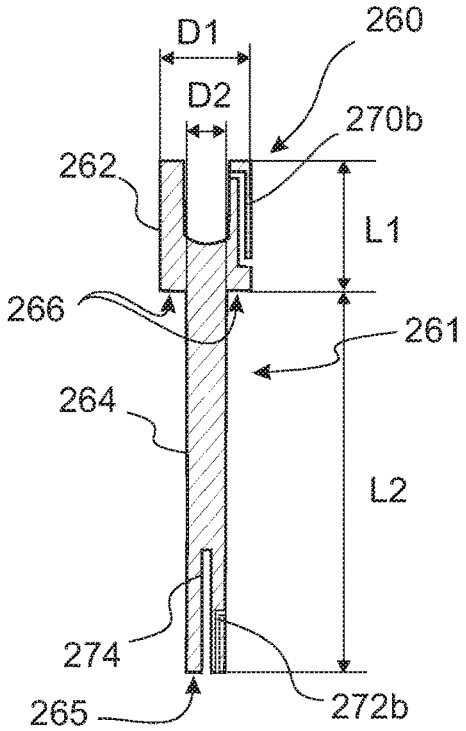
FIG. 2C shows a cross-section of a supporting device of the cone crusher according to the embodiment of FIG. 2A.
Figure 2D:
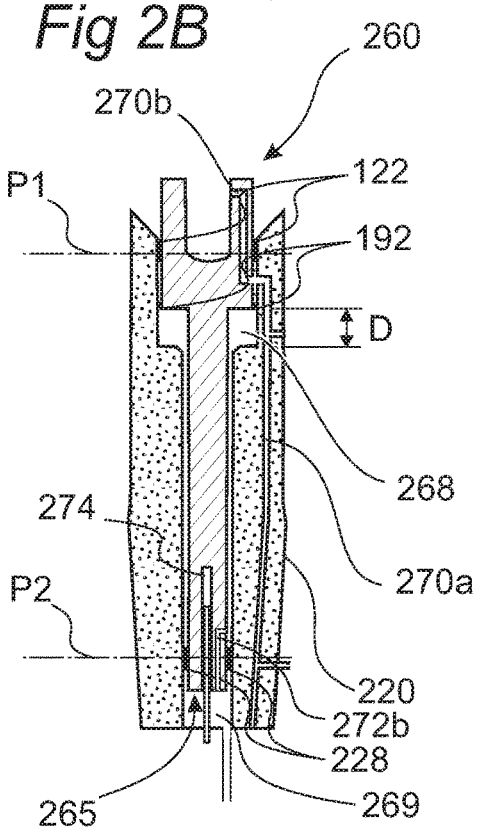
FIG. 2D shows a cross-section of the supporting device and the main shaft according to the embodiment of FIG. 2A.

As best illustrated in FIGS. 1B-D, the upper portion 162 and the lower portion 164 have different outer dimensions as defined transverse to the shaft axis A. Thus, a pressure-active surface 166 is formed at a transition between the upper portion 162 and the lower portion 164 so as to form a variable-volume compression chamber 168 within the cavity 121 below said pressure-active surface 166. The variable-volume compression chamber 168 is arranged to be filled with hydraulic oil H for providing the vertical support and displaceability of the crushing head, as will be further discussed later. Specifically, for the axisymmetric example, the upper portion 162 has a first outer radial diameter D1 and the lower portion 164 has a second, smaller, outer radial diameter D2. A ratio between the first outer radial diameter D1 and the second outer radial diameter D2 is within the range 1.25-4. For the example embodiment, the ratio is 2. A ratio between a vertical dimension L2 of the lower portion 164 and a vertical dimension L1 of the upper portion 162 is preferably at least 3, even though it could in some embodiments be less. The lower portion 164 of the supporting device 160 extends downwards within the main shaft 120. When the supporting device 160 is in a lowermost vertical displacement position, the lower portion 164 of the support device 160 extends downwards within the cavity 121 of the main shaft 120 such that parts of said lower portion 164 extends below the upper parts of the frame 133 on which the eccentric 140 is supported and below the eccentric 140. This achieves a stabilising effect on the supporting device 160, said device being less susceptible to bending. In other embodiments of the invention it is not necessary for the lower portion 164 to extend that far.

The supporting device 160 is slidably arranged within the cavity 121. The supporting device 160 is transversely supported within the cavity 121 at least at an upper support position P1 at which the upper portion 162 is transversely supported by the main shaft 120, and at a lower support position P2 at which the lower portion 164 is transversely supported by the main shaft 120. As can be seen in FIGS. 1A and 1B, the supporting device 160 is further transversely supported within the cavity 121 at an intermediate support position P3 located in between the upper P1 and lower P2 support positions, and at which intermediate support position P3 the lower portion 164 is transversely supported by the main shaft 120. Specifically, for the example embodiment, the intermediate support position P3 is located immediately beneath an intermediate sealing 190 which may be flush, or at least near, a bottom of the variable-volume compression chamber 168. The distance between the intermediate support position P3 and the bottom surface 167 of the compression chamber 168 is illustrated in FIG. 1D as the distance V. The intermediate support position P3 may be used in a situation where sealing is provided at an intermediate position along the length of the lower portion 164 such that hydraulic oil H is only present at an upper portion of the main shaft 120 and does not reach lowermost portions of the main shaft 120. This intermediate support position P3 has the advantage that the seal arranged at an intermediate position will be supported and thus less prone to wear. If hydraulic oil H is present all the way to the lowermost portions of the main shaft 120, the intermediate support position P3 and intermediate seals 190 can be omitted, as will be discussed later with reference to FIGS. 2A-D.

The support points may be achieved in different ways. As can be seen in FIGS. 1A and D, an upper radial support bearing 122 connects, at the upper support position P1, the upper portion 162 of the supporting device 160 with an inner wall 123 of the cavity 121. At the lower support position P2, a lower radial support bearing 128 is indicated. The lower radial support bearing 128 may comprise a bearing arranged in the inner wall 123 of the cavity 121 but may also be provided by a bushing, for example in the form of a ring, arranged on an outer surface 161 of the supporting device 160. Further, as can be seen in FIGS. 1B and 1D, the cavity 121 has a reduced thickness towards the bottom. This has the advantage that when a supporting device 160 having a lower radial support bearing 128 arranged on its outer surface 161 is inserted into the cavity, the lower radial support bearing 128 will only come in contact with the inner wall 123 of the cavity 121 towards the bottom of the cavity 121. This greatly reduces the labour intensity of the assembly. At the intermediate support position P3, intermediate radial support bearing 124 is indicated. As mentioned elsewhere in this application, the intermediate radial support bearings are not necessarily required.

The cone crusher, especially so the bearings thereof, are in constant need of lubrication during operation. For the purpose, the cone crusher comprises a lubricating-oil channel system 170 configured to provide lubricating oil L to, for example, the set of axial bearings 126, the axial bearings 180, the radial support bearings 122, 124 and the radial bearings 182, 184. The lubricating-oil channel system 170 includes a lubrication oil chamber 169 formed between a bottom surface 165 of the lower portion 164 of the supporting device 160 and the inner wall 123 of the cavity 121 of the main shaft 120. Inlet channels 170*a* are arranged within the supporting device 160 at a bottom thereof for receiving lubrication oil L from the lubrication oil chamber 169. The inlet channels 170*a* fluidly connects within the supporting device 160 to transversely oriented sub channels 170*c* which fluidly connects to the cavity 121 at a vertical the side of the lower portion 164. Lubricating oil L may then enter the inlet channels 170*a* of the supporting device 160 via the oil supply channel 170*b* and lubrication oil chamber 169 independent on the vertical position of the supporting device 160.

As illustrated in FIG. 1C, the lower portion 164 of the supporting device 160 comprises a recessed portion 164*a* so as to form a gap between the lower portion 164 of the supporting device 160 and the inner wall 123 of the cavity 121 for allowing lubricating oil L entering the cavity 121 from the sub channels 170*c* to reach the intermediate radial support bearings 124. Transition channel 125 is provided within the main shaft 120 and transition channel 129 is arranged within the eccentric 140 to direct lubrication oil L to the radial bearings 182, 184 arranged between the eccentric 140 and the main shaft 120 and between the eccentric 140 and the crushing head 110. Upper supply channel 170*e* is provided within the supporting device 160 to direct lubrication oil L to the set of axial bearings 126 of the bearing assembly 127. Lubrication oil L will also be present in chamber 135 formed within the crushing head 110 and the lubrication oil L will enter the radial bearings 182, 184 and reach the axial bearings 180 beneath the eccentric 140. Excessive lubrication oil amounts may also be taken care of by means of dedicated draining openings (not shown in the figures) leading from the chamber 135. Further to be seen in FIG. 1A is a sensor arrangement for detection of the position of the supporting device 160. A sensor receiving channel 174 having a magnet is arranged within the lower portion 164. A sensor rod 175 is arranged within the sensor receiving channel 174 and sensor 176 is arranged to detect the position of the supporting device 160 by sensing the position of the magnet. The sensor rod 175 as such does not move, instead the relative position between the sensor rod 175 and the supporting device 160 will change as the supporting device 160 moves.

As illustrated in FIG. 1A, the main shaft 120 comprises a hydraulic-oil channel system configured to provide hydraulic oil H to the compression chamber 168 for providing said vertical support and displaceability of the crushing head 110. The hydraulic-oil channel system comprises a hydraulic oil channel 172*a* which is arranged at least in part within the main shaft 120, radially offset to the centre axis A, such that the hydraulic oil channel 172*a* fluidly connects to the compression chamber 168 at a bottom surface 167 thereof.

In order to withstand the pressure of the hydraulic oil H, which typically is in the range 10-450 bar, and maintain the pressure within the compression chamber 168, the supporting device 160 further comprises sealings 190, 192 for sealingly connecting surfaces 161 of the supporting device 160 with surfaces 123 of the cavity 121. This enables to hermetically seal off the compression chamber 168 from the rest of the cavity 121. One such sealing is the intermediate sealing 190 located between the lower portion 164 of the supporting device 160 and the inner wall 123 of the cavity 121. The intermediate sealing 190 prevents pressurized hydraulic oil H from leaking from the compression chamber 168 to the intermediate radial support bearing 124 and mix with the lubricating oil L. The intermediate sealing 190 may be arranged flush with the bottom surface 167 of compression chamber 168. Another sealing, the upper sealing 192, can be seen arranged between the upper portion 162 of the supporting device 160 and the inner surface 123 of the cavity 121. Even though the sealings 190, 192 are arranged between the compression chamber 168 and the supporting positions P1, P3, they may in other embodiments be arranged such that the support positions P1, P3 are arranged between the sealings 190, 192 and the compression chamber 168.

FIGS. 2A-2D describe another embodiment 200 of the invention. The reference numbers of these figures corresponds to those of FIGS. 1A-1D with a few exceptions. One such difference is that the lubrication oil L is provided through a lubricating-oil channel system 270 which comprises main feed channel 270*a* arranged within the walls of the main shaft 220, and upper connecting channel 270*b* formed within the upper portion 262 of the supporting device 260. Another difference between the embodiment 200 and the embodiment 100 is that the hydraulic oil H is provided to the variable-volume compression chamber 268 via the cavity 221 itself. Specifically, a main feed channel 272*a* and a lower connecting channel 272*b* for hydraulic oil H are provided. Hydraulic oil H is provided to a further compression chamber 269 formed below the supporting device 260 via the main feed channel 272*a*. The hydraulic oil H is then further transported to the compression chamber 268 via the lower connecting channel 272*b* which is defined within the lower portion 264 of the supporting device 260, and further via the cavity 221. Thus, for the embodiment 200 there is no need to provide a separate hydraulic oil supply channel all the way up to the variable-volume compression chamber 268 (such as the hydraulic oil channel 172*a* of FIG. 1A).

The shape of lower portion 264 of the supporting device 260 differs somewhat from the shape of the lower portion 164 of the supporting device 160. Specifically, the lower portion 264 does not have a recessed portion (e.g. corresponding to 164*a* in FIG. 1C). Instead, surfaces 261 of the lower portion 264 are cylindrically shaped defining a cross section having a constant diameter D2 independent on axial position. The sensor receiving channel 274 is similar to the sensor receiving channel 174 of FIGS. 1A-D and has a magnet and is arranged within the lower portion 264. Sensor rod 175 is arranged within the sensor receiving channel 274 and sensor 176 is arranged to detect the position of the supporting device 260 by sensing the position of the magnet. As can be seen in e.g. FIGS. 2A and 2C, also the upper portion 262 of supporting device 260 differs somewhat from that of the embodiment shown in FIGS. 1A-1D. Also, as evident from a comparison of FIGS. 2B and 2A, the shape of the cavity 221 is somewhat different than the shape of the cavity 121. Specifically, the inner wall 223 of the cavity 221 is cylindrically shaped and has a uniform cross section along the axial direction.

FIGS. 2A-2D also differs from the FIGS. 1A-1D in that no intermediate support P3 and no sealing 190 is provided. Instead hydraulic oil H is present along more or less the entire length of the lower portion 264 and only support positions P1 and P2 are necessary. Lower radial support bearing 228 is thus lubricated using hydraulic oil H instead of lubricating oil L. Furthermore, the presence of hydraulic oil H at the bottom surface 265 of the supporting device 260 enable a further compression chamber 269 to be formed. Thus, for the cone crusher 200, there are two compression chambers, the (upper) compression chamber 268 where the hydraulic oil H exerts pressure on pressure active surface 266 of the supporting device 260, and a (lower) compression chamber 269 wherein the hydraulic oil H exerts pressure on the bottom surface 265 of the supporting device 260. Additional compression chamber 269 thus adds to the total pressure-active area of the supporting device 260.

The person skilled in the art realizes that the present invention by no means is limited to the preferred embodiments described above. On the contrary, many modifications and variations are possible within the scope of the appended claims. Additionally, variations to the disclosed embodiments can be understood and effected by the skilled person in practicing the claimed invention, from a study of the drawings, the disclosure, and the appended claims.

The invention claimed is:

1. A cone crusher comprising:

a crushing head being rotatably arranged about a substantially vertical main shaft and on which crushing head a first crushing liner is mounted;

a frame on which a second crushing liner is mounted, such that the first crushing liner and the second crushing liner together defines a crushing gap;

an eccentric rotatably arranged about a shaft axis defined by the main shaft;

a drive unit arranged to rotate said eccentric such that the crushing head, which is rotatably arranged on the eccentric, executes a gyratory pendulum movement for crushing of material introduced into the crushing gap, and a supporting device being arranged inside a cavity of said main shaft, said supporting device being arranged to support the crushing head, and to be displaceable along the shaft axis for adjusting the width of the crushing gap, wherein the supporting device has an upper portion enclosed by the crushing head, said upper portion being arranged to provide said support to the crushing head, and a lower portion extending downwards within the cavity of the main shaft, wherein the upper portion and the lower portion have different outer dimensions as defined transverse to the shaft axis, such that a pressure-active surface is formed at a transition between the upper portion and the lower portion so as to form a variable-volume compression chamber within the cavity below said pressure-active surface, wherein the supporting device is transversely supported within the cavity at least at an upper support position at which the upper portion is transversely supported by the main shaft, and at a lower support position at which the lower portion is transversely supported by the main shaft via a lower radial support bearing, and wherein the cone crusher includes a hydraulic oil channel arranged such that hydraulic oil can bypass the lower radial support bearing to reach the variable compression chamber.

2. The cone crusher according to claim 1, wherein the supporting device is axisymmetric and wherein the upper portion has a first outer radial diameter and the lower portion has a second, smaller, outer radial diameter.

3. The cone crusher according to claim 2, wherein a ratio between the first outer radial diameter and the second outer radial diameter is within the range 1.25-4.

4. The cone crusher according to claim 1, wherein a ratio between a vertical dimension of the lower portion and a vertical dimension of the upper portion is at least 1.

5. The cone crusher according to claim 1, wherein, when the supporting device is in a lowermost vertical displacement position, the lower portion of the support device extends downwards within the cavity of the main shaft such that parts of said lower portion extends below the eccentric.

6. The cone crusher according to claim 1, wherein the cone crusher further comprises a bearing assembly comprising a set of axial bearings connecting the upper portion of the supporting device with the crushing head, and an upper radial support bearing connecting, at the upper support position, the upper portion of the supporting device with an inner wall of the cavity.

7. The cone crusher according to claim 6, wherein at least one from the support device and the main shaft comprises a lubricating-oil channel system configured to provide lubricating oil to the set of axial bearings and/or the upper radial support bearing.

8. The cone crusher according to claim 1, wherein the supporting device further comprises an upper sealing for sealingly connecting surfaces of the upper portion of the supporting device with surfaces of the cavity.

9. The cone crusher according to claim 1, wherein the supporting device is transversely supported within the cavity at an intermediate support position located in between the upper and lower support positions, and at which intermediate support position the lower portion is transversely supported by the main shaft.

10. The cone crusher according to claim 9, wherein the intermediate support position is located adjacent a bottom surface of the variable-volume compression chamber.

11. The cone crusher according to claim 9, wherein the cone crusher further comprises an intermediate radial support bearing connecting, at the intermediate support position, the supporting device with an inner wall of the cavity.

12. The cone crusher according to claim 9, wherein the supporting device further comprises an intermediate sealing for sealingly connecting surfaces of the supporting device with surfaces of the cavity.

13. The cone crusher according to claim 12, wherein the intermediate support position is located below the intermediate sealing which seals the variable-volume compression chamber.

14. The cone crusher according to claim 9, wherein the main shaft comprises a hydraulic-oil channel system configured to provide hydraulic oil to the compression chamber for providing said support and displaceability of the crushing head.

15. The cone crusher according to claim 2, wherein a ratio between the first outer radial diameter and the second outer radial diameter is within the range 1.75-2.5.

16. The cone crusher according to claim 1, wherein a ratio between a vertical dimension of the lower portion and a vertical dimension of the upper portion is 1.5.

17. The cone crusher according to claim 1, wherein a ratio between a vertical dimension of the lower portion and a vertical dimension of the upper portion is at least 3.

18. The cone crusher according to claim 1 wherein the hydraulic oil channel is formed within the main shaft.

19. The cone crusher according to claim 1 wherein at least a portion of the hydraulic oil channel is formed within the lower portion of the supporting device.

* * * * *